US005788133A

United States Patent [19]

Mareno

[11] Patent Number: 5,788,133

[45] Date of Patent: Aug. 4, 1998

[54] WAKEBOARD RACK

[75] Inventor: John Mareno, Brentwood, Calif.

[73] Assignee: M&M Equipment Company LLC, Stockton, Calif.

[21] Appl. No.: 773,965

[22] Filed: Dec. 26, 1996

[51] Int. Cl.[6] ..... B60R 9/10

[52] U.S. Cl. ..... 224/406; 224/917.5; 224/532; 224/534; 224/564; 114/343; 211/70.5; 211/107

[58] Field of Search ..... 224/917.5, 531, 224/532, 533, 534, 545, 555, 558, 564, 567, 568; 114/343, 364, 253; 211/70.5, 107

[56] References Cited

U.S. PATENT DOCUMENTS

| | | | |
|---|---|---|---|
| 3,701,436 | 10/1972 | Adams | 114/364 |
| 3,811,143 | 5/1974 | Page | 114/343 |
| 3,925,836 | 12/1975 | Simmonds | 114/364 |
| 4,056,220 | 11/1977 | Trimble | 114/364 |
| 4,582,015 | 4/1986 | Hunter | 114/343 |
| 4,729,535 | 3/1988 | Frazier et al. | 224/406 |
| 4,823,723 | 4/1989 | Brooks | 114/343 |
| 5,094,373 | 3/1992 | Lovci | 224/532 |
| 5,105,754 | 4/1992 | Collins | 114/343 |
| 5,190,256 | 3/1993 | Macchiarella | 114/253 |
| 5,373,978 | 12/1994 | Buttchen et al. | 224/532 |
| 5,573,165 | 11/1996 | Bloemer et al. | 224/917.5 |

*Primary Examiner*—Henry J. Recla
*Assistant Examiner*—Gregory M. Vidovich
*Attorney, Agent, or Firm*—Flehr Hohbach Test Albritton & Herbert LLP

[57] ABSTRACT

A rack apparatus for storing at least one wakeboard (27,29) in a skiboat having a vertically extending tow pylon (12), comprising: a collar assembly (20) being adapted to support the rack and wakeboards from the vertically extending pylon (12), a plurality of spaced apart lower support arms (23) connected to collar assembly (20) and adapted to support at least one horizontally oriented wakeboard (27) thereon, a plurality of spaced apart upper support arms (25) connected to collar assembly (20) and adapted to support at least one horizontally oriented wakeboard (29) thereon, and a plurality of resiliently extensible and flexible attaching members (30) or attaching straps (31) connected to lower support arms (23), the flexible attaching members (30) being constructed of a length sufficient to wrap around at least one wakeboard (27,29).

13 Claims, 9 Drawing Sheets

WAKEBOARD RACK

TECHNICAL FIELD

The present invention relates to devices for the support and storage of sporting equipment and more particularly to an apparatus for storing wakeboards and water skis in a boat.

BACKGROUND OF THE INVENTION

Wakeboarding is an aquatic sport in which the wakeboarding enthusiast stands on a wakeboard, similar in appearance to a snowboard or skateboard, while it is towed from a skiboat with a speed sufficient to allow the wakeboard to support the user on the surface of the water. As such, wakeboarding is closely related to water skiing on a single or slalom ski with the primary difference being that the wakeboard is wider and shorter than a slalom ski, and wakeboards have upwardly-curved back ends which facilitate a wider variety of wakeboarding maneuvers or tricks. As is true of slalom water skis, wakeboards also have two boot-like bindings to receive the skier's feet and a downwardly-extending fin at the bottom rear of the wakeboard which provides the user with both lateral stability and maneuverability.

While generally shorter than water skis, wakeboards still take up a considerable amount of space when not in use, particularly in relatively compact skiboats. When one or more different individuals desire to use a variety of different wakeboards, carrying these wakeboards in a skiboat is rather cumbersome. These wakeboards alone, or in combination with water skis, simply tend to pile up and to occupy an undesirably large percentage of space on the floor of the water skiboat. Having two upwardly-projecting bindings or boots attached to the top surface of each wakeboard, it is also quite difficult to effectively stack wakeboards. In addition, haphazardly piling wakeboards, one upon another, tends to scratch or damage both the boots and the board surfaces which are often decorated or finely finished. Furthermore, boating safety becomes somewhat compromised since persons in the boat can trip over loose or poorly stacked wakeboards.

Consequently, what is desired is a system for protecting and storing wakeboards in a skiboat such that they can be easily stored and retrieved and such that they do not consume an awkward amount of space or bounce loosely around in the skiboat.

DISCLOSURE OF INVENTION

The present invention provides an apparatus for storing at least one wakeboard in a skiboat having a vertically extending tow pylon, and comprises briefly, a collar adapted to be supported from the vertically extending tow pylon, a plurality of spaced apart lower support arms or members connected to the collar and adapted to support at least one horizontally oriented wakeboard thereon, a plurality of spaced apart upper support arms or members connected to the collar and adapted to support at least one horizontally oriented wakeboard thereon, and a plurality of attaching members, which are preferably either flexible hook and loop type attaching straps or resiliently flexible cords, connected to the support arms and having a length sufficient to wrap around at least one wakeboard for securement of the same to the rack.

BEST MODE OF CARRYING OUT THE INVENTION

Wakeboards are short, wide boards upon which a user stands while being towed by a skiboat. Having a left and right boot attached to their top surface and up-turned front and rear ends, wakeboards have proven quite awkward to store in a skiboat. Typically, when wakeboarding and/or water skiing a group of people will take turns skiing or wakeboarding, one or two at a time. When not skiing or boarding, they and their equipment usually will be stored on the boat while others are skiing or boarding. While wakeboarders can share equipment, it is more typical for each participant to have his or her own board. Accordingly, wakeboard enthusiasts tend to encounter a significant problem in connection with wakeboards and water skis piling up or lying about in the skiboats as other skiers or boarders are being towed.

As will be shown, the present invention provides a rack for safely storing up to four wakeboards simultaneously, and/or an equivalent number of water skis, such that they are each readily accessible, protected from potential damage, and such that they do not occupy any space on the floor of the skiboat.

Similar to water skiers, wakeboarders are pulled by a tow line from the skiboat. This tow line may be connected to a boat transom, but in modern skiboats, it is often connected to the top of a vertical tow pylon proximate a middle of the boat. The use of a tow pylon is desirable as wakeboarders tend to traverse a large arc to the left and to the right of the rear of the boat in order to be able to jump the boat's wake and perform other tricks. It is this passing across the boat's wake which has given the sport of wakeboarding its name. The tow pylon enables the tow line to freely swing back and forth through a large arc safely above the heads of the occupants seated in the skiboat, and couples the drag of the wakeboarder or water skier to the center of the skiboat so as to enhance the skiboat's performance.

Figure 1A:
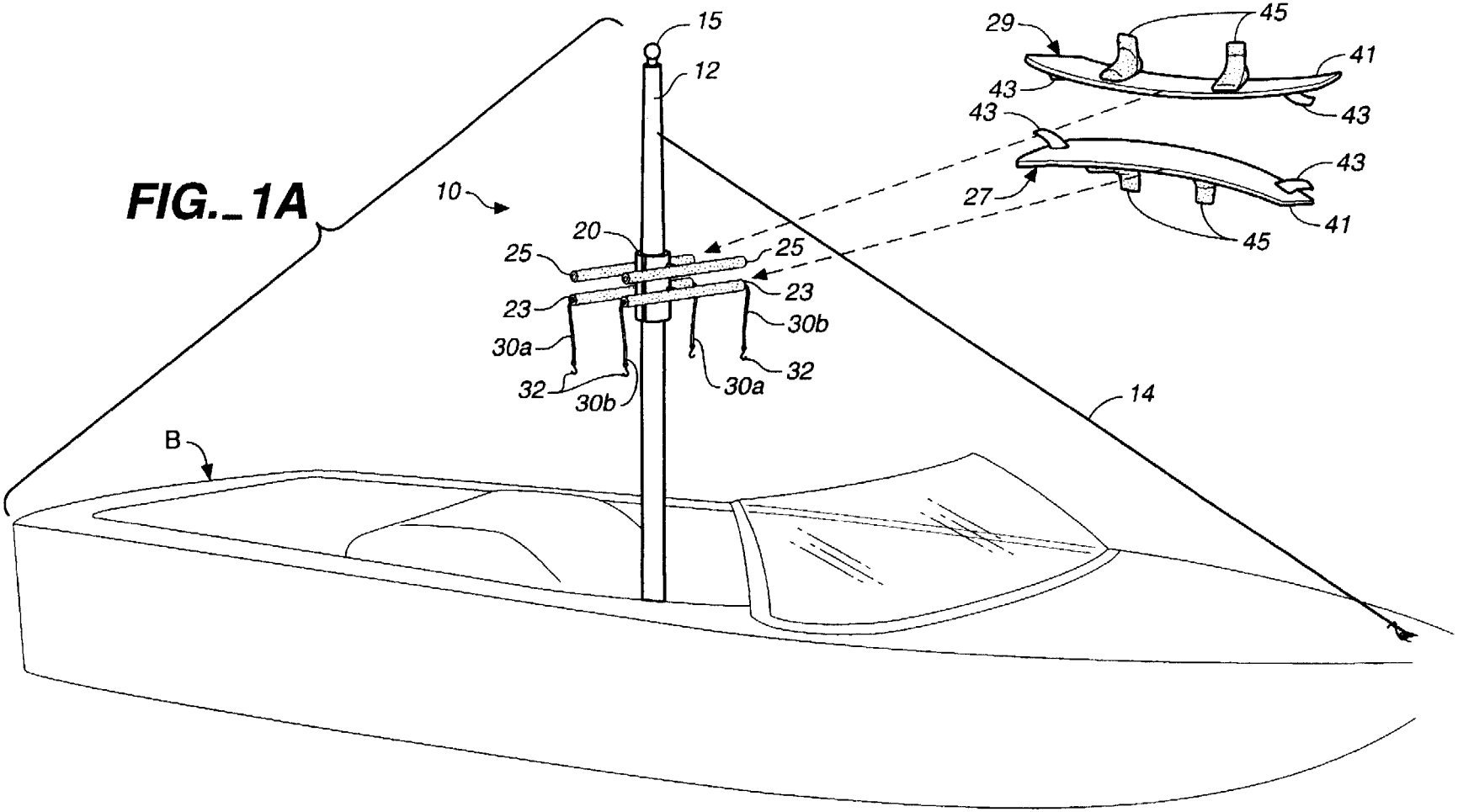
FIG. 1 is a perspective view of a first embodiment of the wakeboard rack constructed in accordance with the present invention and shown mounted to a skiboat tow pylon with two wakeboards.
Figure 1B:
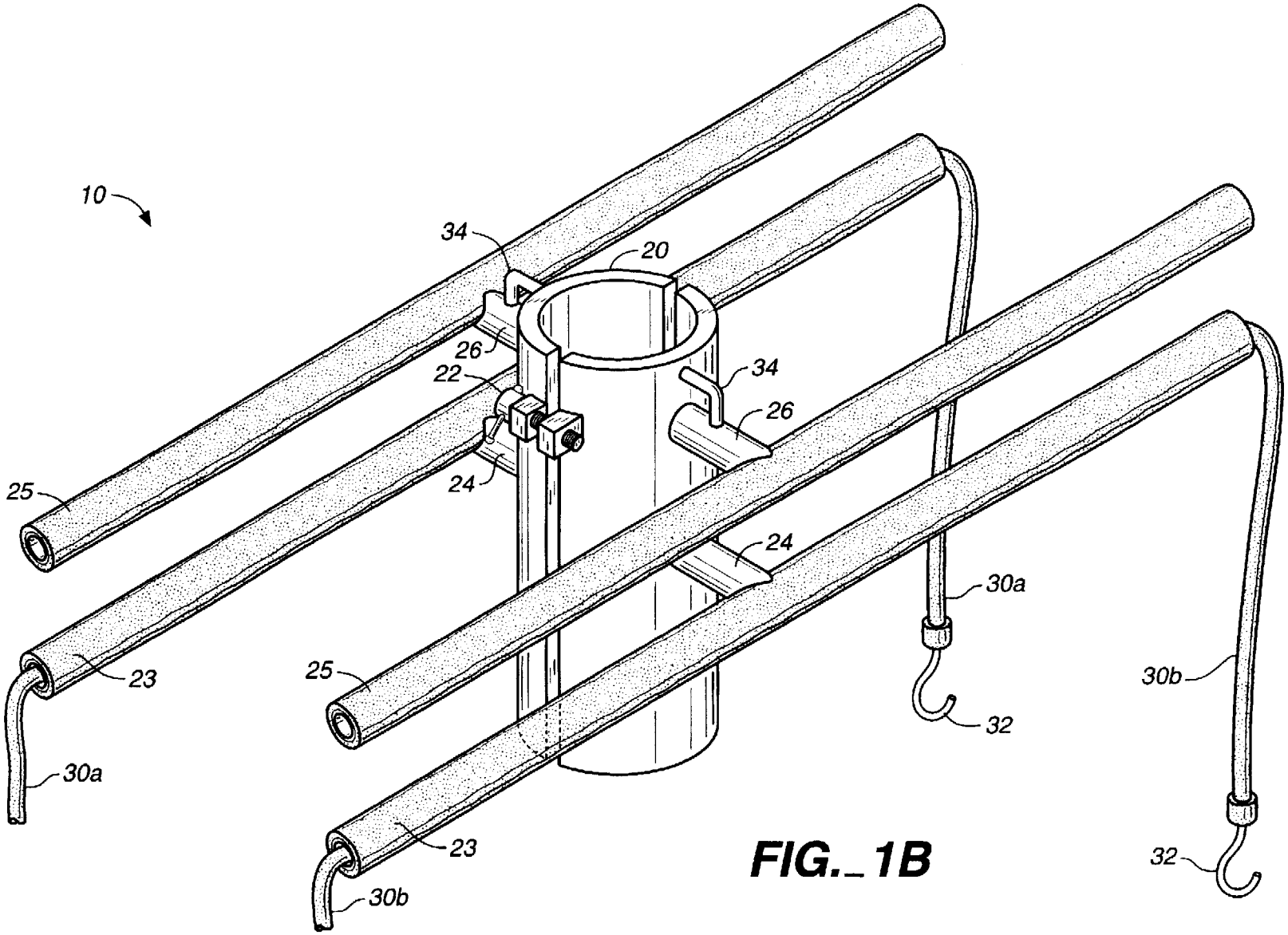
Figure 2:
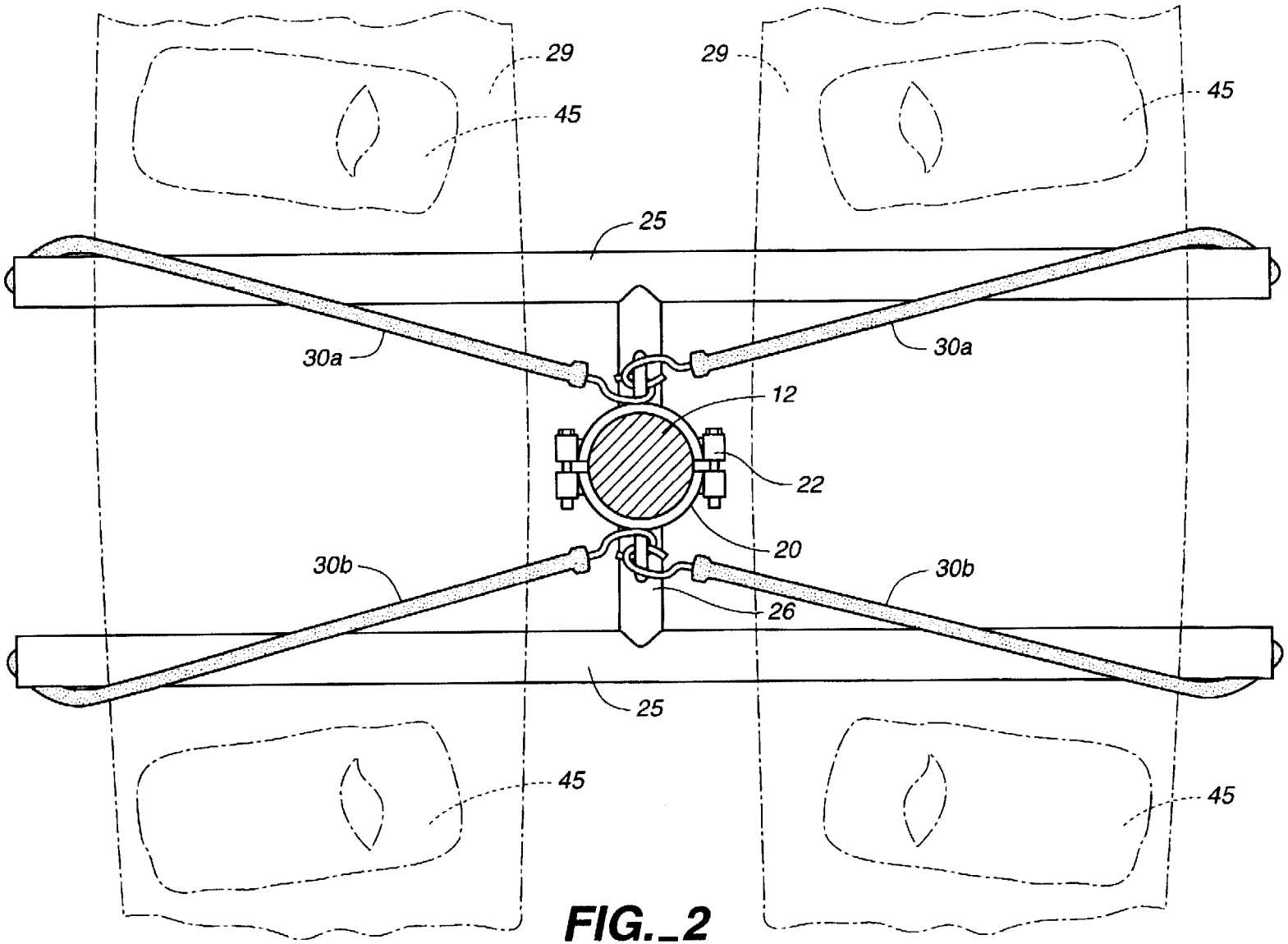
FIG. 2 is a top plan view of the wakeboard rack shown in FIG. 1 with two wakeboards shown in phantom.

The vertically-extending tow line pylon is mounted to the floor of a skiboat at about the middle of the boat with the tow line connected to freely pivot at a connection point at the top end of the pylon. This assembly is best seen in FIG. 1, in which a wakeboard rack 10 is shown connected to such a vertically-extending tow pylon 12. The bottom of this pylon is in turn connected to the floor of a boat, (not shown for ease of illustration). A tow rope 14 is connected at the top end 15 of pylon 12, typically being received into a coupling assembly. Connection of tow rope 14 to top end 15 of pylon 12 thus enables the wakeboarder to swing through angles both far to the left and far to the right of the back of the boat, thus traversing the wake of the boat as desired. Furthermore, by connecting tow rope 14 at such an elevated vertical height, tow rope 14 can swing back and forth without any danger of tow rope 14 hitting or swinging into any occupant seated in the back of the skiboat.

An important aspect of wakeboard storage rack 10 of the present invention, therefore, is that it is adapted for mounting to tow pylon 12 in a location on the skiboat which has theretofore been unused. As can be seen from the various FIGURES, the present wakeboard rack enables a plurality of wakeboards to be stored on pylon 12 such that these wakeboards can be held above the driver, passengers and structural components of the boat and below tow line 14. Storing wakeboards at such an elevated location prevents the wakeboards from taking up any floor space in the boat and, as will be shown, protects both the top and bottom surfaces of these wakeboards and protects the boots attached thereto. An additional benefit of having one or more wakeboards stored vertically above the occupants in the boat is that this arrangement also can provide some shading from the sun.

The present wakeboard rack 10 has a collar or sleeve assembly 20 which can be attached from a side or slipped over the vertically-extending tow line pylon 12. Collar assembly 20 can be clamped firmly into position by means of set screws 22. In this way, wakeboard rack 10 can be easily and quickly fastened at any desired height desired by the user and can be tightly secured against sliding down pylon 12.

A first embodiment of wakeboard rack 10 is seen in FIGS. 1, 2, 3 and 4. A second embodiment of wakeboard rack 10 is seen in FIGS. 5, 6, 7, and 8. As can be seen, extending horizontally from collar assembly 20 are two horizontally spaced apart lower support arms or members 23, which are supported by transverse arms or members 24 from collar assembly 20. A plurality of horizontally spaced apart upper support member 25 are supported by transverse members 26 from collar or sleeve 20. Lower support members 23 are preferably substantially parallel and are located at the same height above the skiboat such that a wakeboard 27 can be horizontally rested upon lower support members 23. Lower support arms 23 have a length dimension from collar 20 which is at least about equal to a width dimension of wakeboard 27. In the preferred form arms 23 extend outwardly of opposite sides of collar 20 so that a wakeboard 27 can be stored on either or both sides or pylon 12 with the wakeboard length dimension oriented cross-wise or perpendicular to arms 23 and the bindings or boots 45 depending downwardly between arms 23. Thus, arms 23 should be spaced apart by an amount sufficient to receive the wakeboard boots therebetween.

Similarly, upper support members 25 are preferably parallel and equidistant above the floor of the skiboat in the same horizontal plane such that an upper wakeboard 29 can be horizontally positioned thereon. Upper support member or arms 25 should extend from collar assembly 20 at a height above arms 23 which enables a wakeboard to be received therebetween. It is desirable, however, for rack compactness, for the upper arms to be vertically relatively close to the lower arms. As can be appreciated from these FIGURES, the present wakeboard rack is, therefore, designed to hold up to four wakeboards specifically by holding a lower wakeboard 27 on either side of pylon 12 and a upper wakeboard 29 on either side of pylon 12.

Figure 3:
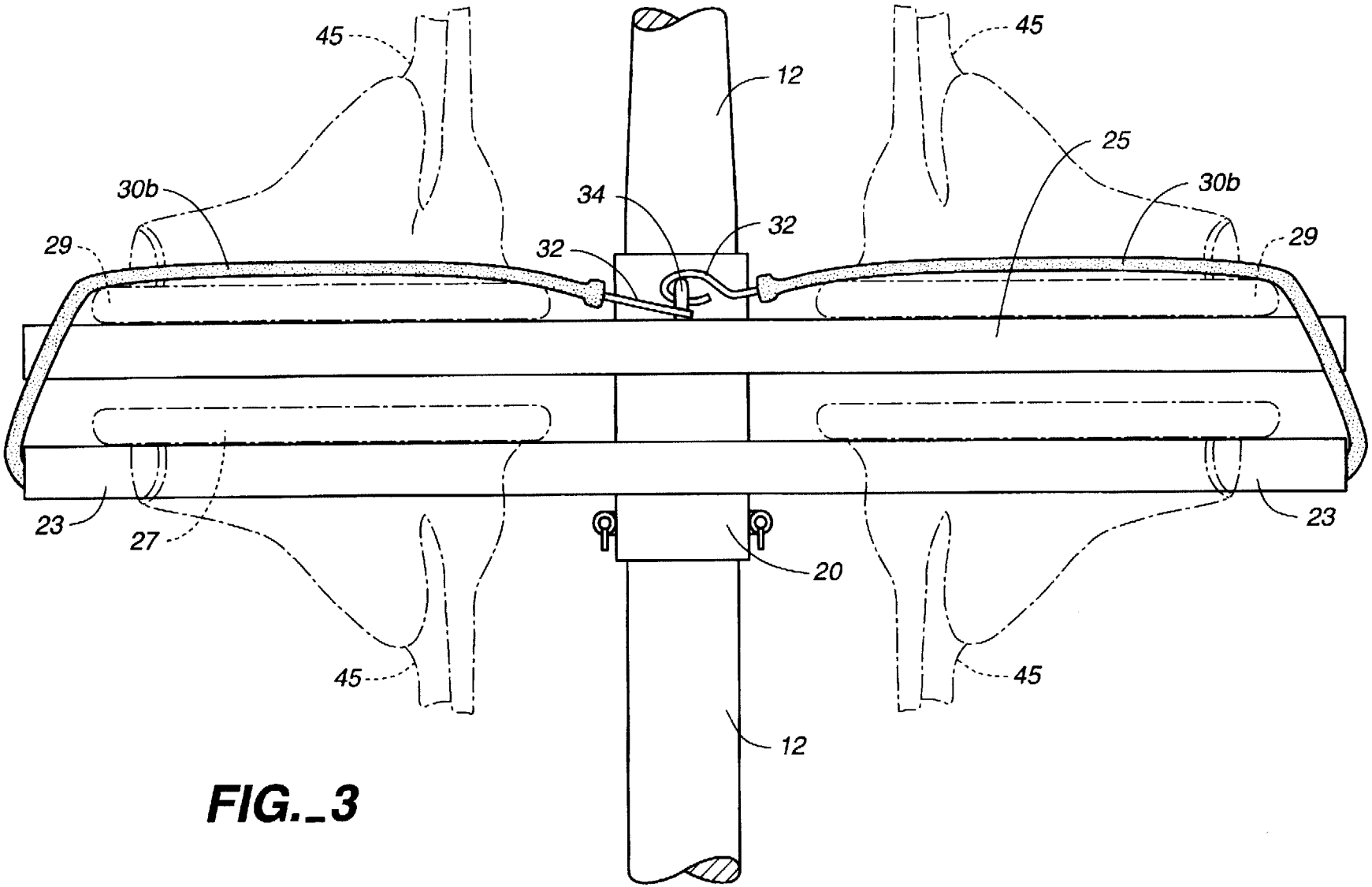
FIG. 3 is a side elevational view of the wakeboard rack shown in FIG. 1, with four wakeboards shown in phantom.
Figure 4:
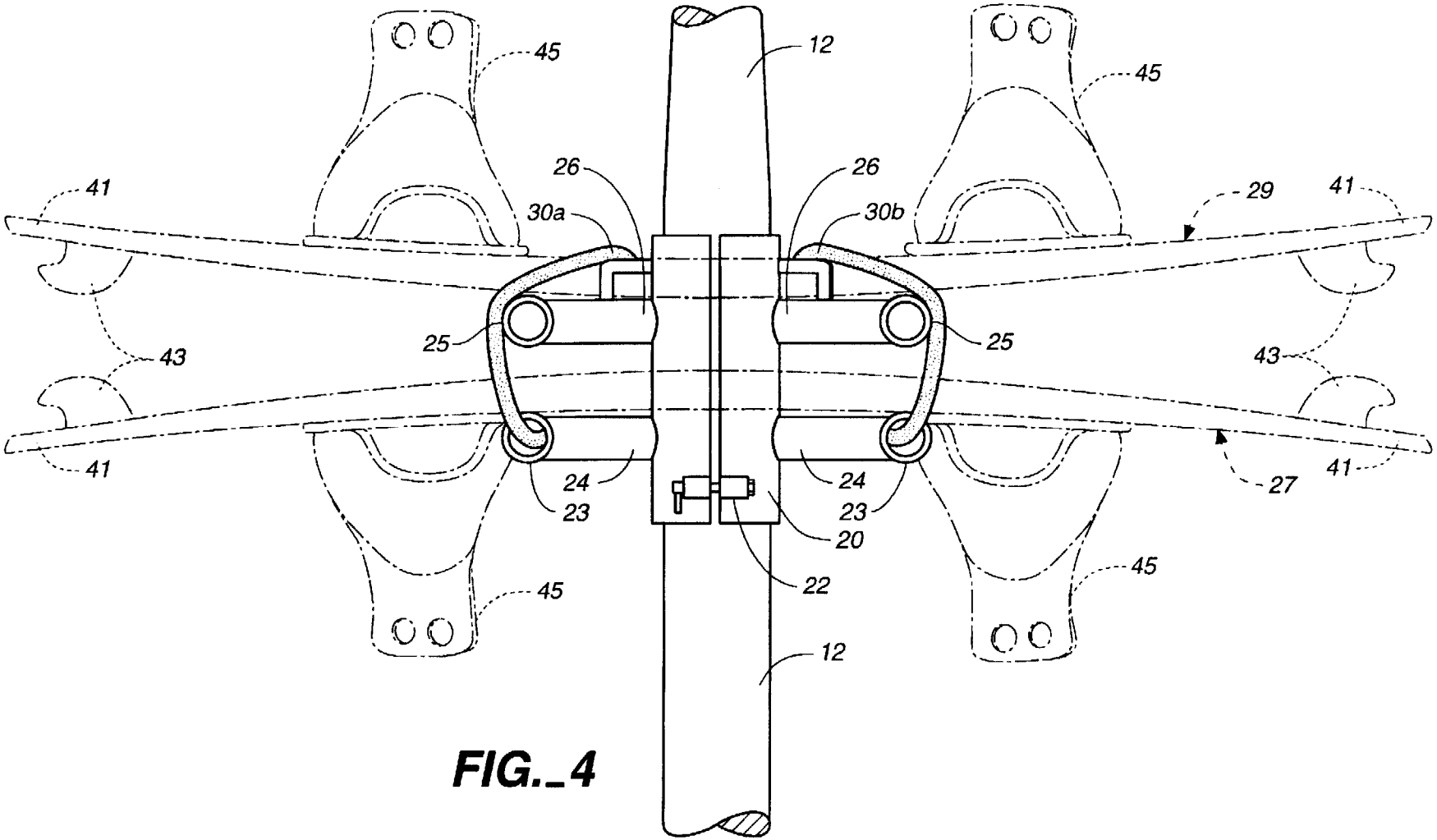
FIG. 4 is a front elevational view of the wakeboard rack shown in FIG. 1 with four wakeboards shown in phantom.
Figure 7:
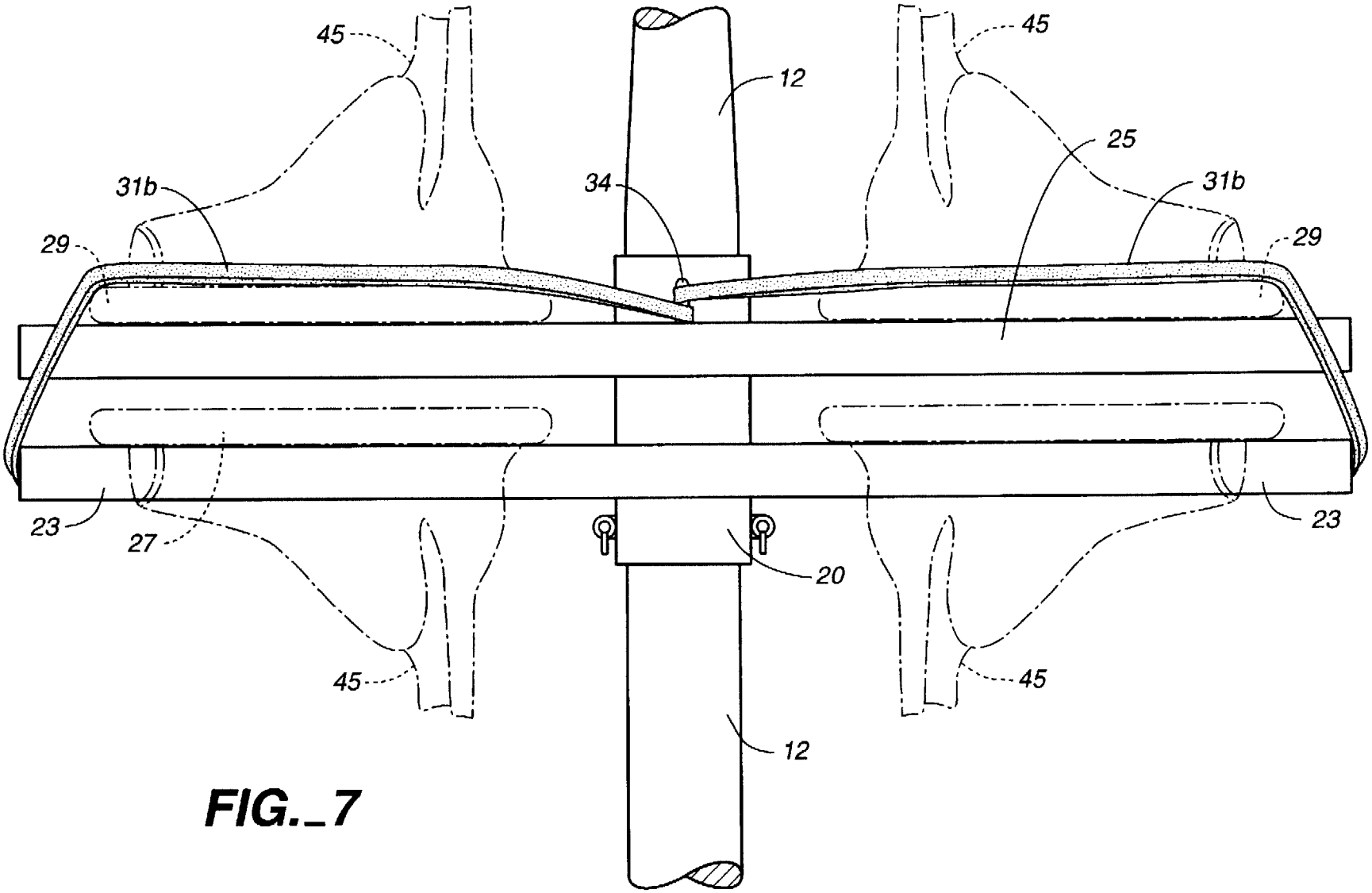
FIG. 7 is a side elevational view of the wakeboard rack shown in FIG. 5, with four wakeboards shown in phantom.
Figure 8:
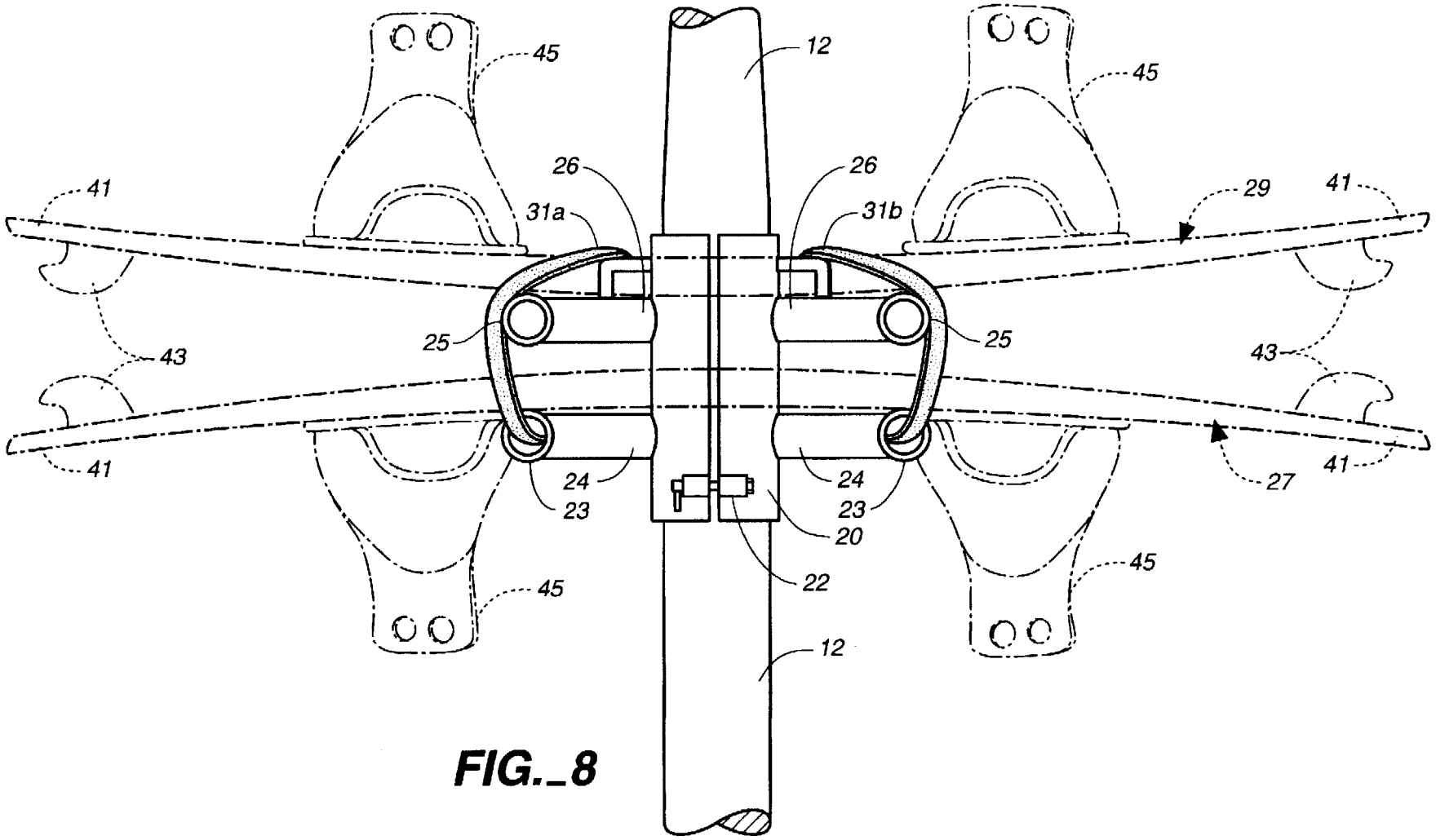
FIG. 8 is a front elevational view of the wakeboard rack shown in FIG. 5 with four wakeboards shown in phantom.

As can be seen, the present wakeboard rack provides a simple and effective stacking solution for up to four wakeboards, or an equivalent volume of water skis, and the boards or skis are held at a location which is both conveniently accessible and out of the way. A particular problem which had been encountered prior to the development of the present invention was that wakeboards were particularly difficult to stack together simply because they had boots permanently attached thereto which extended upwards from their top surfaces. By stacking wakeboards bottom-to-bottom, as shown, the present invention overcomes this problem. Moreover, as is seen in FIGS. 3 and 7, wakeboards 27 and 29 are vertically spaced sufficiently apart, when resting in the present rack, such that both of the wakeboards can be placed with their fin ends facing either the same or different directions. Fins 43 will not contact one another, regardless of the orientation in which they are placed, because the upwardly-curved ends 41 of the wakeboards enable them to be stacked bottom-to-bottom.

Both lower support arms or members 23 and upper support arms or members 25 are preferably constructed of one inch diameter aluminum tubing with polyethylene foam wrapped around their surface so as to provide a non-scratch surface which will not damage the wakeboards. Alternatively, members 23 and 25 can be injected molded from plastic. In this way, wakeboards can be quickly stowed and retrieved without any danger of their upper or lower surfaces becoming scratched or damaged. While arms 23 and 25 are shown as pairs having free ends, it also will be understood that the free ends of horizontally aligned arms 23 and 25 could be connected by a U-shaped end, not shown. It is preferable, however, that arms 23 and 25 be open at the ends so that the wakeboards can be slid into the rack without having to lift bindings 45 over a U-shaped connecting end. It also would be possible to form arms 23 from a single piece of material with a U-shaped transverse cross section and side edges which act as rails or spaced apart support surfaces on which the wakeboard can rest with the boots extending downwardly between the spaced apart side edges or rail surfaces.

A novel structure is provided for securely fastening the wakeboards to wakeboard rack 10. In particular, as is seen in the first embodiment of FIG. 1, a plurality of resiliently extensible cord-like attaching members **30*a* and 30*b* are connected and extend from the opposite ends of lower support members 23. Resilient attaching members 30 each have a hook 32 at their free ends, and corresponding loop 34 (for receiving hook 32) is provided along horizontal rack members 26. In this way, hook 32 may be hooked into loop 34 such that either one or two wakeboards 27 and 29 can be held firmly in position at either side of wakeboard rack 10, as shown for example in FIGS. 2 and 3. (In FIG. 1, flexible attaching members 30*a* and 30*b* are shown unlatched and in FIGS. 2, 3 and 4, flexible attaching members 30*a* and 30*b* are shown with their hooks 32 received into loops 34). Attaching members 30 are thus designed to be of a length sufficient to wrap around one wakeboard, but are easily stretchable so as to reach around two wakeboards to thereby ensure that their hook 32 is tightly held in loop 34, whether one or two wakeboards are being held at each side of the wakeboard rack. Resiliently extensible members 30 are preferably provided by stretchable elastic Bungee cords with one end essentially permanently connected to the lower support members 23 and the other end provided with a hook 32. Attaching members 30 are thus able to securely hold a single wakeboard resting on either the lower support members 23 or the upper support members 25**, or two wakeboards, with one resting on each of the lower and upper support members, respectively. In this way, the same flexible attaching cord is easily used for holding in position one or more wakeboards regardless of whether they are supported by the lower or upper support arms.

Figure 5:
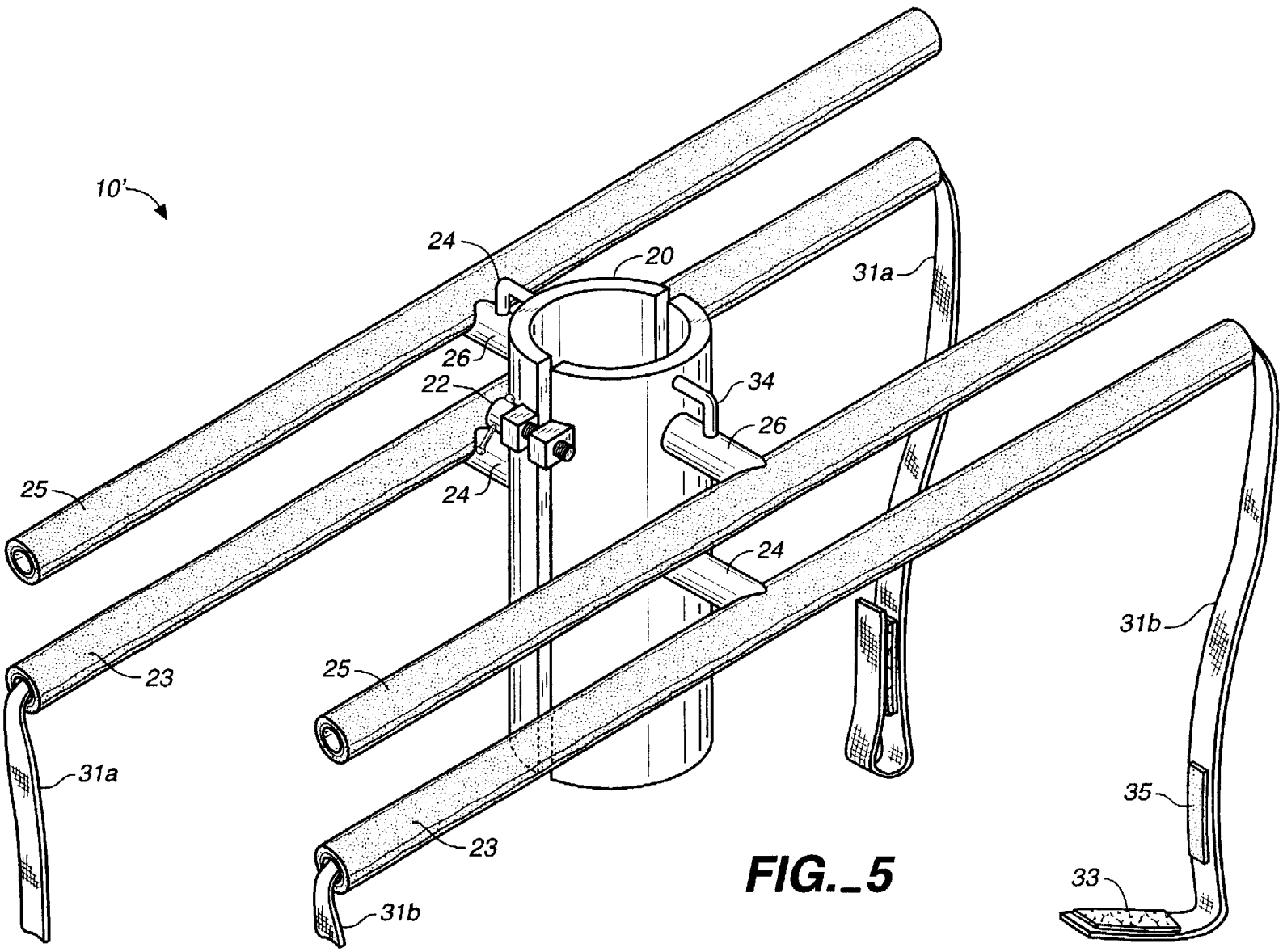
FIG. 5 is a perspective view of a second embodiment of the wakeboard rack constructed in accordance with the present invention.
Figure 6:
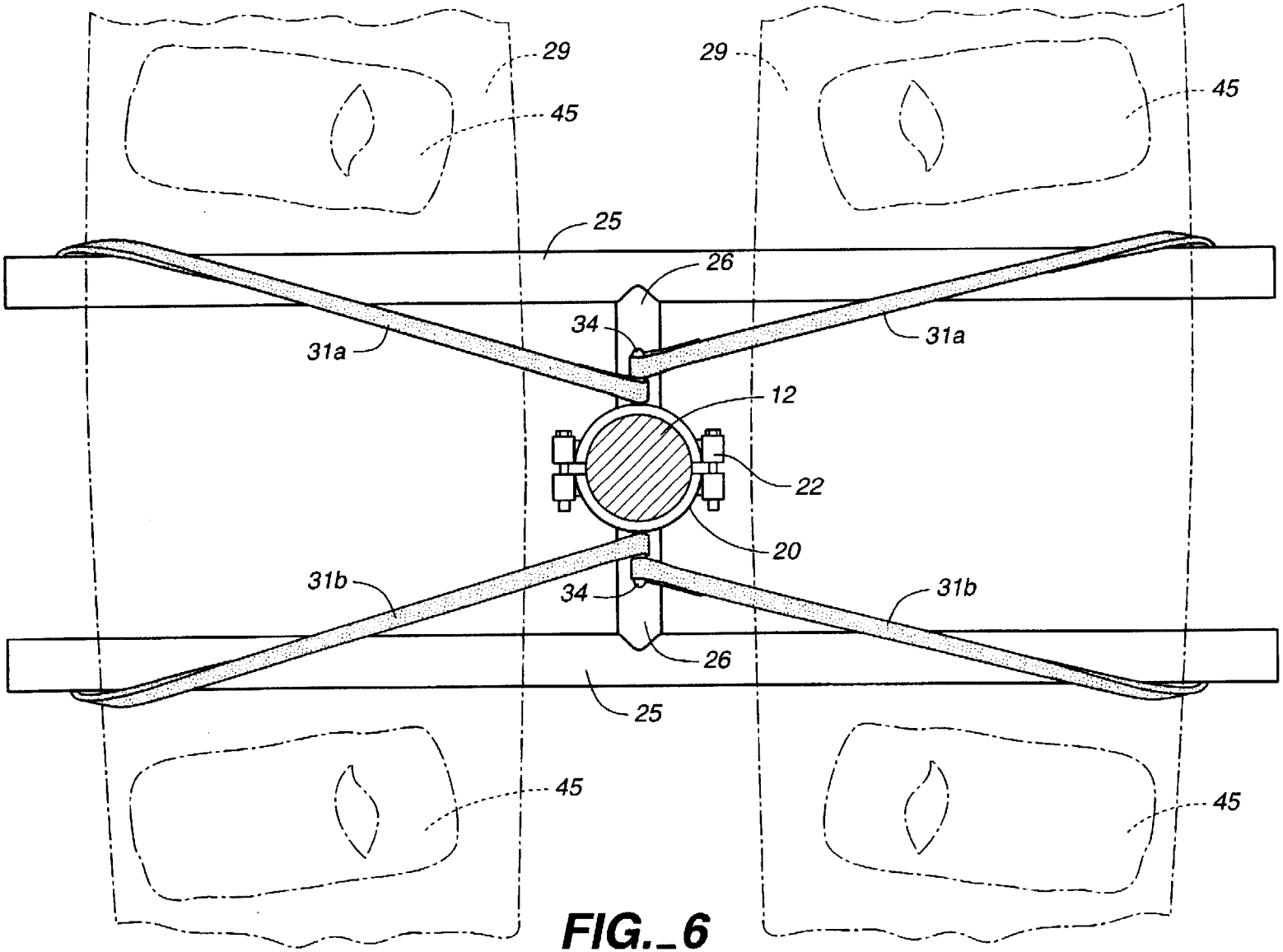
FIG. 6 is a top plan view of the wakeboard rack shown in FIG. 5 with four wakeboards shown in phantom.

In a second embodiment, another novel structure is provided for securely fastening the wakeboards to wakeboard rack 10. In particular, as is seen in FIG. 5, a plurality of flexible attaching straps 31*a* and 31*b* are connected and extend from the opposite ends of lower support members 23. Attaching straps 31 each have hook and loop fastening surfaces 33 and 35 of the type sold under the mark VELCRO near their free ends, and corresponding loop 34 (for receiving straps 31) is provided along horizontal rack members 26. In this way, strap 31 may be inserted through loop 34, and folded back upon itself such that the hook and loop fastening surfaces 33 and 35 can be fastened together such that either one or two wakeboards 27 and 29 can be held firmly in position at either side of wakeboard rack 10, as shown for example in FIGS. 6, 7 and 8. (In FIG. 5, flexible attaching straps 31*a* and 31*b* are shown unlatched and in FIGS. 6, 7 and 8, flexible attaching straps 31*a* and 31*b* are shown received into loops 34). Attaching straps 31 are thus designed not only to be of a length sufficient to wrap around one wakeboard, pass through the loop 34 and then connect back upon themselves, placing surfaces 33 and 35 in contact, but are specifically designed to be long enough so as to reach around two wakeboards, pass through the loop 34 and then connect back upon themselves, placing surfaces 33 and 35 in contact. Surfaces 33 and 35 are designed to be of a length sufficient such that regardless of whether strap 31 wraps around one or two wakeboards, surfaces 33 and 35 can be positioned in tight contact with one another. Attaching straps 31 are preferably formed with one end essentially permanently connected to the lower support members 23 and the other end provided with hook and loop fasteners 33 and 35. Attaching straps 31 are thus able to securely hold a single wakeboard resting on either the lower support members 23 or the upper support members 25, or two wakeboards, with one resting on each of the lower and upper support members, respectively. In this way, the same flexible attaching strap is easily used for holding in position one or more wakeboards regardless of whether they are supported by the lower or upper support arms.

A further important advantage of the present design is that flexible attaching cords or members 30 (or straps 31) are wrapped as a pair (ie: 30*a* and 30*b* or 31*a* and 31*b*), around each of the wakeboards such that members 30 (or straps 31) pass between bindings or boots 45 of each wakeboard. In this way, both wakeboards 27 and 29 are prevented from slipping back and forth and are prevented from slipping out from under attaching members 30 (or straps 31). As can readily be seen, this restraint is seen whether the wakeboard is oriented topside-up, as is the case of wakeboard 29 resting upon support arms 25, or upside-down, as is the case of wakeboard 27 resting upon support arms 23.

The present invention provides an effective solution to the problem of wakeboard storage, keeping the wakeboards out of the way of the occupants of the skiboat and yet storing them within easy reach. The invention also provides a simple system for securing wakeboards and water skis in position in the rack so that they do not present a safety problem on board the skiboat.

What is claimed is:

1. A storage rack for storing at least one wakeboard in a skiboat having a vertically extending tow pylon, said storage rack comprising:

a collar assembly adapted to be attached to said tow pylon for support of said rack and said at least one wakeboard from said tow pylon;

at least one support member providing a first pair of horizontally spaced apart support surfaces connected to said collar assembly and extending horizontally outwardly therefrom by a distance at least about equal to a width dimension of said wakeboard, said first pair of support surfaces being spaced apart by a distance sufficient to receive wakeboard boots therebetween for support of a horizontally oriented wakeboard thereon; and an attaching device connected to said support member and adapted to secure a wakeboard to said support member when supported thereon, wherein, said support member is formed to position said support surfaces at a first height relative to said collar assembly; and a second support member providing a second pair of horizontally spaced apart support surfaces connected to said collar assembly and extending horizontally therefrom by a distance of at least equal to a width dimension of a wakeboard at a position above said first support surfaces for receipt of a wakeboard thereon, said second pair of support surfaces being positioned sufficiently above said first pair of support surfaces for receipt of a wakeboard therebetween.

2. The storage rack as defined in claim 1, wherein, said first pair of support surfaces is provided by a pair of independent lower support arms; and said second pair of support surfaces is provided by a pair of independent upper support arms.

3. The storage rack as defined in claim 2 wherein, said attaching device is adapted to secure a wakeboard to each of said upper support arms and said lower support arms.

4. The storage rack as defined in claim 3, and a plurality of said attaching devices with one attaching device attached to at least one of said lower support arms and said upper support arms.

5. The storage rack as defined in claim 4 wherein, each of said attaching devices is provided by a resiliently extensible cord.

6. The apparatus for storing at least one wakeboard in a skiboat as set out in claim 2, wherein said collar assembly is adapted to receive said vertically extending pylon therein and to suspend said apparatus at a vertical height on said pylon.

7. The apparatus for storing at least one wakeboard in a skiboat as set out in claim 2, wherein said plurality of flexible attaching devices are adapted to securely fasten to said collar assembly.

8. The apparatus for storing at least one wakeboard in a skiboat as set out in claim 7, wherein said flexible attaching devices are adapted with hooks, and said collar assembly is adapted with loops to receive said hooks.

9. The apparatus for storing at least one wakeboard in a skiboat as set out in claim 22, wherein said flexible attaching devices are elastically stretchable.

10. The apparatus for storing at least one wakeboard in a skiboat as set out in claim 2, further comprising:

at least one upwardly-facing wakeboard lying horizontally across said upper support arms.

11. The apparatus for storing at least one wakeboard in a skiboat as set out in claim 2, further comprising a) at least one downwardly-facing wakeboard lying horizontally across said lower support arms.

12. The apparatus for storing at least one wakeboard in a skiboat as set out in claim 2, further comprising a) said vertically-extending pylon.

13. The storage rack as defined in claim 4 wherein, each of said attachment devices is provided by a strap having hook and loop fasteners proximate its free end.

* * * * *